US010338522B2

(12) United States Patent
Tomino

(10) Patent No.: US 10,338,522 B2
(45) Date of Patent: Jul. 2, 2019

(54) IMAGE FORMATION APPARATUS

(71) Applicant: Konica Minolta, Inc., Chiyoda-ku, Tokyo (JP)

(72) Inventor: Toshiaki Tomino, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/439,057

(22) Filed: Feb. 22, 2017

(65) Prior Publication Data

US 2017/0261928 A1 Sep. 14, 2017

(30) Foreign Application Priority Data

Mar. 9, 2016 (JP) ..... 2016-045926

(51) Int. Cl.
*G03G 15/00* (2006.01)
*G03G 21/20* (2006.01)

(52) U.S. Cl.
CPC ..... *G03G 21/20* (2013.01); *G03G 21/206* (2013.01); *G03G 15/6517* (2013.01)

(58) Field of Classification Search
CPC ..... G03G 15/6573
USPC ..... 399/384
See application file for complete search history.

(56) References Cited

U.S. PATENT DOCUMENTS 5,164,782 A * 11/1992 Nagayama ..... G03G 15/20 399/320
5,205,210 A * 4/1993 Mathis ..... B41F 19/062 101/32
5,569,144 A * 10/1996 Schwyn ..... B29C 53/50 413/72
2005/0084307 A1* 4/2005 Muratani ..... G03G 15/6576 399/406
2005/0251977 A1* 11/2005 Lipponen ..... D21F 3/0209 28/100
2006/0099020 A1* 5/2006 Sabater Vilella ..... B41F 23/02 399/407
2007/0071528 A1* 3/2007 Iida ..... G03G 15/6508 399/384
2009/0103959 A1* 4/2009 Koyama ..... G03G 15/6573 399/341
2014/0186080 A1* 7/2014 Ikeda ..... G03G 15/6573 399/341

FOREIGN PATENT DOCUMENTS

JP 2015-075693 A 4/2015

* cited by examiner

*Primary Examiner* — Anthony H Nguyen
(74) *Attorney, Agent, or Firm* — Buchanan Ingersoll & Rooney PC

(57) ABSTRACT

A cooling device has: first and second guide rollers disposed in the body of a cooling device on upstream and downstream sides, respectively, as seen in a direction in which a continuous medium is fed, and guiding a cooling belt to move in that direction; and a path selection mechanism allowing selection between a non-abutting transport path which does not cause the continuous medium to abut against the cooling belt and an abutting transport path which causes the continuous medium to abut against the cooling belt.

17 Claims, 7 Drawing Sheets

FIG.6

| SHEET WEIGHT IN GRAMS PER SQUARE METRE (gsm) | 105 OR SMALLER | 106–176 | 177 OR LARGER |
|---|---|---|---|
| THICKNESS OF SHEET | THIN | STANDARD | THICK |
| AMOUNT OF PRESSING | LARGE | MEDIUM | SMALL |
| $\theta$ (IN DEGREES) | 2 | 1.5 | 1 |

IMAGE FORMATION APPARATUS

This application is based on Japanese Patent Application No. 2016-045926 filed with the Japan Patent Office on Mar. 9, 2016, the entire content of which is hereby incorporated by reference.

BACKGROUND OF THE INVENTION

Field of the Invention

The present invention relates to an image formation apparatus which forms an image in an electrophotographic system. An image formation apparatus, whether it may be a color image formation apparatus or a monochrome image formation apparatus, includes a digital copier, a fax, a printer and a similar electrophotographic device, a recorder, a display device etc.

Description of the Related Art

An image formation apparatus of arm electrophotographic system, such as a copier, a printer, a facsimile, and an MFP, supplies an electrostatic latent image formed on a photoreceptor with toner from a developing device to form a toner image. In an image formation apparatus of an electrophotographic system capable of forming an image on a sheet, a film or a similar recording material, a fixing device (a heating device) is used to fix a toner image on the recording material.

Furthermore, for the purpose of preventing recording materials discharged and stacked on a discharging tray or the like from adhering to each other due to softened toner, i.e., blocking, and for the purpose of allowing an image on a recording material to have a desired level of glossiness, an image formation apparatus including a cooling device which cools the recording material after the recording material has passed through a fixing device is disclosed in Japanese Laid-Open Patent Publication No. 2015-75693.

The image formation apparatus disclosed in Japanese Laid-Open Patent Publication No. 2015-75693 is intended to provide printing on a target of a recoding material previously cut to have a prescribed size to be a cut sheet (or a flat sheet). When a cut sheet is cooled the cut sheet after fixing is sandwiched at the opposite surface sides by transporting belts and a cooling device disposed on an inner surface of one transporting belt cools the cut sheet while it is transported (i.e., belt-sandwiched cooling). A heat sink system, a water cooling system, etc. are adopted as the cooling device.

SUMMARY OF THE INVENTION

When a recording material is transported the fixing device may have a fixing roller misaligned, formed in a crown, or pressing with force out of balance and as a result the recording material is transported in a bent direction. When the recording material is a cut sheet, the bending can be adjusted fix each cut sheet.

In contrast, when the recording material is a drop curtain, a flat sheet for a banner which is larger in length than a cut sheet that can be accommodated inside the body of an image formation apparatus (e.g., the A3 size), a rolled sheet, a continuous sheet, or a similar continuous medium, and the recording material is bent, the bending cannot be adjusted as done for the cut sheet, and accordingly, to suppress the bending, the continuous medium is tensioned.

In particular, while the fixing device has a roller pressed into contact to allow fixing and transporting, a bending of a continuous medium resulting from the fixing and transporting is cancelled by tensioning the continuous medium and the continuous medium is thus transported stably.

When the continuous medium is bent the continuous medium repeats meandering until it stabilizes, and it gradually converges. When the above continuous medium is cooled using the belt-sandwiched cooling disclosed in Japanese Laid-Open Patent Publication No. 2015-75693, and the continuous medium meanders, the transporting belt also meanders, and a defect may be caused in a mechanism which activates the transporting belt. Furthermore, providing a gap between the transporting belt and the cooling device to prevent the transporting belt and the cooling device from rubbing against each other may invite inefficient cooling.

The present invention has been made in view of the above issue, and an object thereof is to provide an image formation apparatus using a continuous medium, that has a configuration which can dispense with belt-sandwiched cooling to cool the continuous medium after fixing by heating.

To achieve at least one of the above mentioned objects, an image formation apparatus reflecting one aspect of the present invention is an image formation apparatus of an electrophotographic system capable of forming an image on a continuous medium, comprising: a sheet feeding device configured to feed the continuous medium; a winding device configured to wind up the continuous medium fed from the sheet feeding device; and a body of the image formation apparatus configured to form an image on the continuous medium while the continuous medium is transported between the sheet feeding device and the winding device.

The body of the image formation apparatus includes: a transfer device configured to transfer a prescribed toner image to the continuous medium; a fixing device configured to apply heat to fix the toner image transferred to the continuous medium; and a cooling device configured to cool the continuous medium heated.

The cooling device has: a cooling belt disposed only on the side of one surface of the continuous medium and having a region which at least abuts against the continuous medium moved in a direction in which the continuous medium is fed; a body of the cooling device abutting against the cooling belt on a side of the cooling belt opposite to that thereof abutting against the continuous medium; first and second guide rollers disposed in the body of the cooling device on upstream and downstream sides, respectively, as seen in the direction in which the continuous medium is fed, and guiding the cooling belt to move in that direction; and a path selection mechanism allowing selection between a non-abutting transport path which does not cause the continuous medium to abut against the cooling belt and an abutting transport path which causes the continuous medium to abut against the cooling belt.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 represents a relationship between types of continuous media and inclination angles.

DESCRIPTION OF THE PREFERRED EMBODIMENTS

An image formation apparatus in an embodiment based on the present invention will be described hereinafter with reference to the drawings. Note that in any embodiment described hereafter, when numbers, amounts and the like are referred to, the present invention is not necessarily limited in scope thereto unless otherwise indicated. Identical and corresponding components and parts are identically denoted and may not be described repeatedly. Furthermore, the drawings are not shown in accordance with an actual dimensional ratio, and to help understanding a structure, there is a portion shown with a modified ratio to clarify the structure.

(1) Image Formation Apparatus 1

Figure 1:
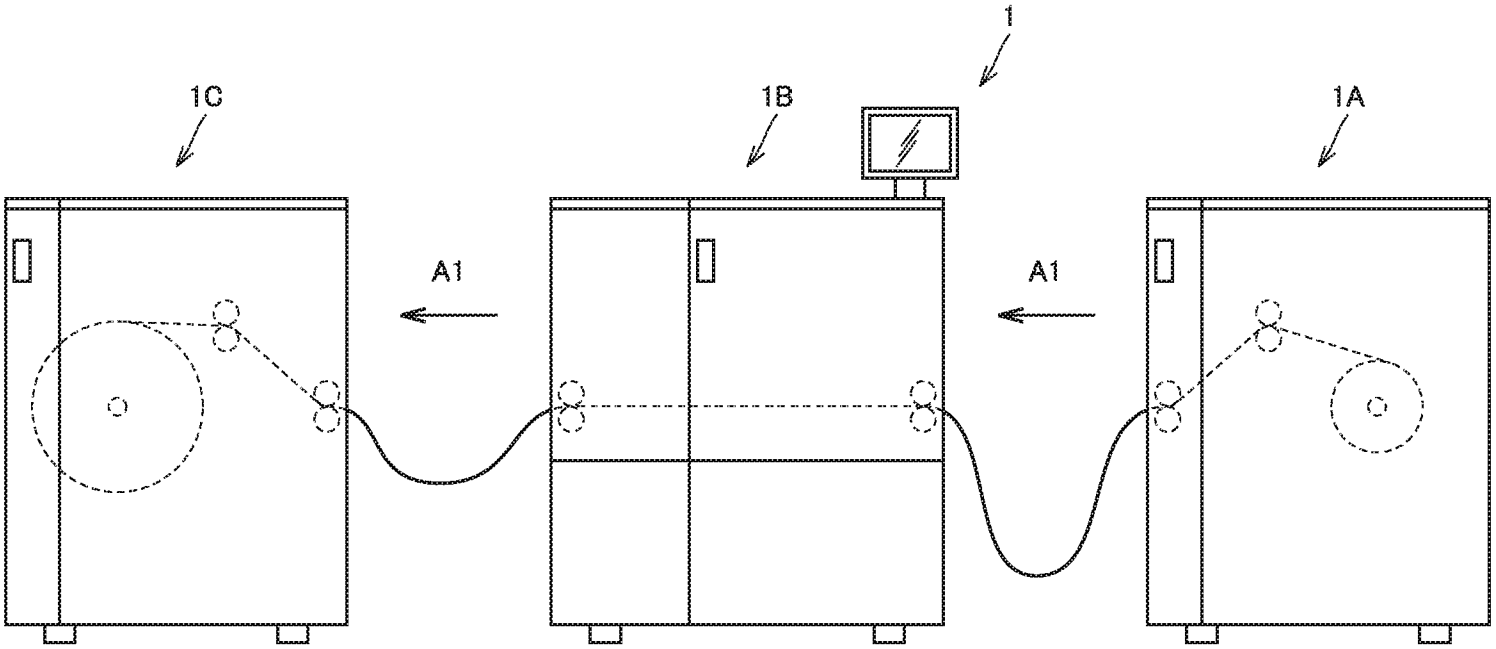
FIG. 1 is a schematic diagram showing a general configuration of an image formation apparatus of an embodiment.
Figure 2:
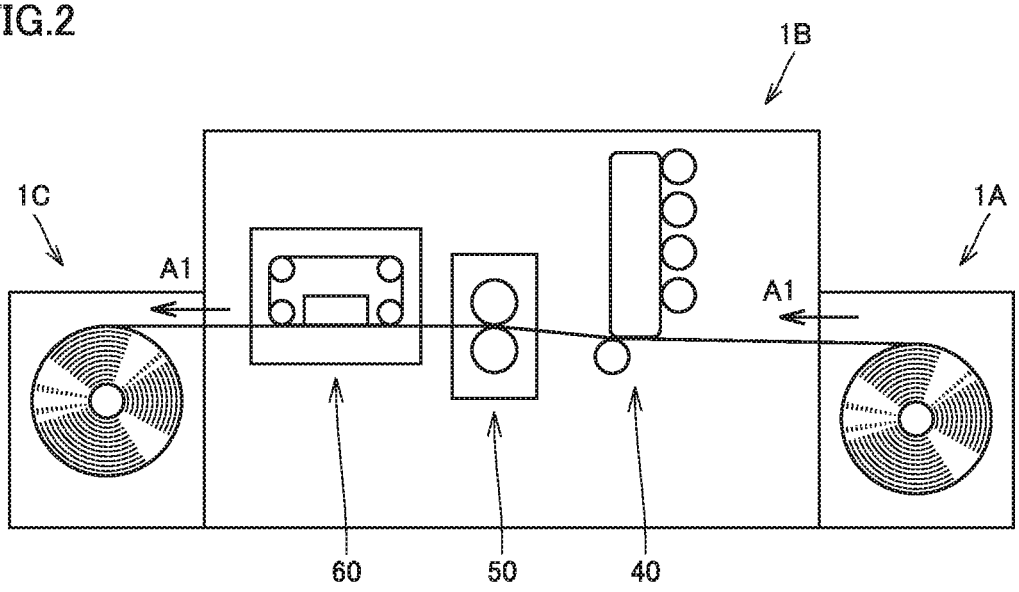
FIG. 2 is a schematic diagram showing an internal configuration of an image formation apparatus of an embodiment.

With reference to FIGS. 1 and 2, a schematic configuration of an image formation apparatus 1 in the present embodiment will be described. FIG. 1 is a schematic diagram showing a general configuration of image formation apparatus 1, and FIG. 2 is a schematic diagram showing an internal configuration of the image formation apparatus.

Image formation apparatus 1 includes a sheet feeding device 1A, a main body 1B of the image formation apparatus, and a winding device 1C. Sheet feeding device 1A has a continuous medium P1 wound in the form of a roll, and continuous medium P1, after being fed from sheet feeding device 1A in a feeding direction A1, passes along a transport path through main body 1B of the image formation apparatus, and after a prescribed image is formed, continuous medium P1 is wound up in winding device 1C in the form of a roll.

When continuous medium P1 is transported, it receives tension T, which is adjusted by a rate of sheet feeding device 1A to feed a sheet and a rate of winding device 1C to wind up the sheet. For example, setting the rate of winding device 1C to wind up a sheet to be faster than the rate of sheet feeding device 1A to feed the sheet allows continuous medium P1 to experience larger tension.

Main body 1B of the image formation apparatus is internally provided with a transfer device 40 which transfers a prescribed toner image to continuous medium P1, an image fixing device 50 which applies heat to fix the toner image transferred to continuous medium P1, and a cooling device 60 which cools continuous medium P1 heated, and they configure a portion of a transport path.

(Cooling Device 60)

Figure 3:
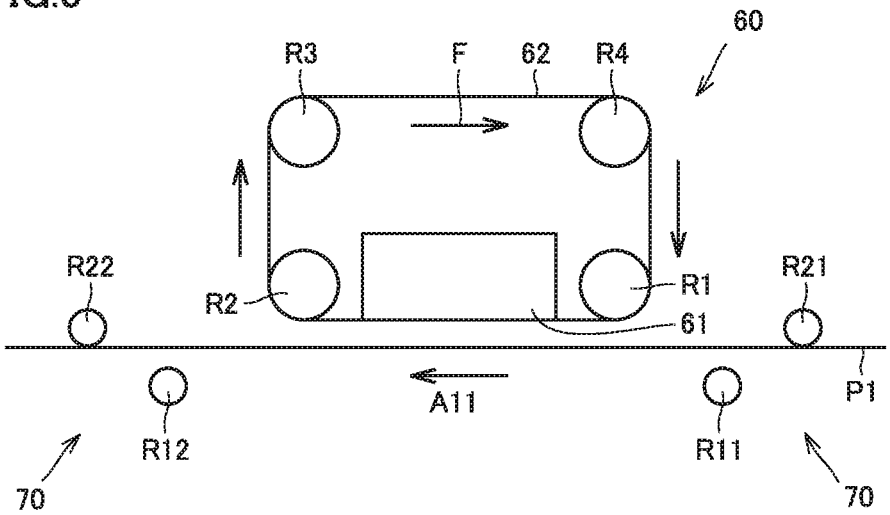
FIG. 3 is a schematic diagram showing a state where a non-abutting transport path of an embodiment is selected.
Figure 4:
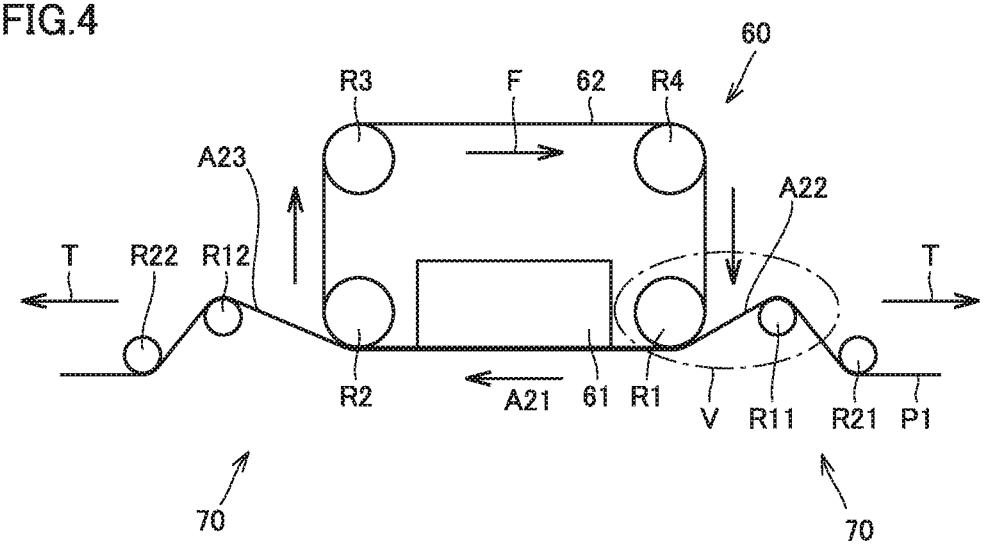
FIG. 4 is a schematic diagram showing a state where an abutting transport path of the embodiment is selected.

Subsequently, with reference to FIG. 3 and FIG. 4, a configuration of cooling device 60, and a configuration of a path selection mechanism 70 allowing selection between a non-abutting transport path A11 which does not cause continuous medium P1 to abut against a cooling belt 62 and an abutting transport path A12 which causes continuous medium P1 to abut against cooling belt 62, will be described. FIG. 3 is a schematic diagram showing a state where non-abutting transport path A11 is selected, and FIG. 4 is a schematic diagram showing a state where abutting transport path A12 is selected.

With reference to FIG. 3, cooling device 60 has cooling belt 62 which is disposed only on the side of one surface of continuous medium P1 (in the present embodiment, on an upper side) and has a region which at least abuts against continuous medium P1 moved in direction A1 in which continuous medium P1 is fed. In the present embodiment, cooling belt 62 in a side view forms a rectangular, infinite loop track.

As seen in direction A1 in which continuous medium P1 is fed, a first guide roller R1 is disposed upstream, a second guide roller R2 is disposed downstream, a third guide roller R3 is disposed over second guide roller R2, and a fourth guide roller R4 is disposed upstream of third guide roller R3 and over first guide roller R1. Cooling belt 62 is wound around these four guide rollers to form the rectangular, infinite loop track in the side view.

Between first guide roller R1 and second guide roller R2, a body 61 of the cooling device is provided which abuts against cooling belt 62 on a side of cooling belt 62 opposite to that thereof abutting against continuous medium P1 (in the present embodiment, on an upper side of cooling belt 62). Although body 61 of the cooling device is not limited in form in particular, a cooling device including a heat sink system, a water cooling system, etc. is adopted.

Furthermore, cooling device 60 includes path selection mechanism 70 allowing selection between non-abutting transport path A11 which does not cause continuous medium P1 to abut against cooling belt 62, as shown in FIG. 3, and abutting transport path A12 which causes continuous medium P1 to abut against cooling belt 62, as shown in FIG. 4.

(Path Selection Mechanism 70)

In the present embodiment, as an example, path selection mechanism 70, as seen in direction A1 in which continuous medium P1 is fed, has an upstream movable guide roller R11 which is upstream of first guide roller R1 and located opposite to first guide roller R1 with continuous medium P1 posed therebetween, and an upstream fixed guide roller R21 which is upstream of upstream movable guide roller R11 and located opposite to upstream movable guide roller R11 with continuous medium P1 posed therebetween.

Specifically, first guide roller R1 and upstream fixed guide roller R21 are located above continuous medium P1, and upstream movable guide roller R11 is located below continuous medium P1 between first guide roller R1 and upstream fixed guide roller R21.

Upstream movable guide roller R11 is provided to be movable between a direction to approach first guide roller R1 and a direction to move away from first guide roller R1. FIG. 3 shows a state where upstream movable guide roller R11 has moved to a position remotest from first guide roller R1, and FIG. 4 shows a state where upstream movable guide roller R11 has moved to a position closest to first guide roller R1.

Upstream fixed guide roller R21 is disposed such that it is fixed at a position in contact with continuous medium P1.

Furthermore, path selection mechanism 70 has a downstream movable guide roller R12 which is downstream of second guide roller R2 and located opposite to second guide roller R2 with continuous medium P1 posed therebetween, and a downstream fixed guide roller R22 which is downstream of downstream movable guide roller R12 and located opposite to downstream movable guide roller R12 with continuous medium P1 posed therebetween.

Specifically, second guide roller R2 and downstream fixed guide roller R22 are located above continuous medium P1, and downstream movable guide roller R12 is located below continuous medium P1 between second guide roller R2 and downstream fixed guide roller R22.

Downstream movable guide roller R12 is provided to be movable between a direction to approach second guide roller R2 and a direction to move away from second guide roller R2. FIG. 3 shows a state where downstream movable guide roller R12 has moved to a position remotest from second guide roller R2, and FIG. 4 shows a state where downstream movable guide roller R12 has moved to a position closest to second guide roller R2.

Downstream fixed guide roller R22 is disposed such that it is fixed at a position in contact with continuous medium P1.

In the above configuration, as shown in FIG. 3, by moving upstream movable guide roller R11 in a direction away from first guide roller R1, and similarly moving downstream movable guide roller R12 in a direction away from second guide roller R2, non-abutting transport path A11 serves as a path which does not cause continuous medium P1 to abut against cooling belt 62.

In contrast, as shown in FIG. 4, by moving upstream movable guide roller R11 toward first guide roller R1, and similarly moving downstream movable guide roller R12 toward second guide roller R2, abutting transport path A12 serves as a path which causes continuous medium P1 to abut against cooling belt 62.

As described above, path selection mechanism 70 moves upstream movable guide roller R11 and downstream movable guide roller R12 to allow selection between non-abutting transport path A11 which does not cause continuous medium P1 to abut against cooling belt 62 and abutting transport path A12 which causes continuous medium P1 to abut against cooling belt 62.

Thus, path selection mechanism 70 is included to allow selection between non-abutting transport path A11 which does not cause continuous medium P1 to abut against cooling belt 62 and abutting transport path A12 which causes continuous medium P1 to abut against cooling belt 62, and continuous medium P1 can thus be cooled without being sandwiched at the opposite sides.

Accordingly, if continuous medium P1 should meander, continuous medium P1 has only one side surface pressed, and when compared with the belt-sandwiched cooling in which continuous medium P1 is sandwiched at the opposite sides, an effect on continuous medium P1 can be reduced.

(Winding Angle)

Figure 5:
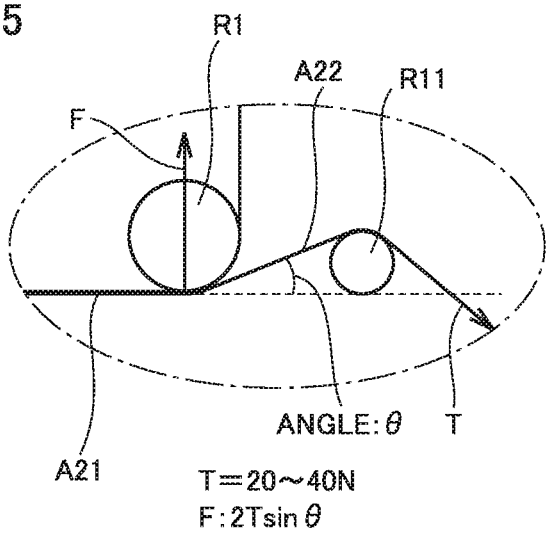
FIG. 5 is an enlarged view of an area surrounded by a circle V shown in FIG. 4.

With reference to FIG. 5 and FIG. 6, a winding angle of continuous medium P1 around first guide roller R1 and second guide roller R2 by path selection mechanism 70 will be described. FIG. 5 is an enlarged view of an area surrounded by a circle V shown in FIG. 4, and FIG. 6 represents a relationship between types of continuous media and inclination angles.

With reference to FIG. 5, in a state where path selection mechanism 70 selects abutting transport path A12, relative to a passing path A21 allowing continuous medium P1 passing between first guide roller R1 and second guide roller R2 to abut against cooling belt 62, a passing path A22 of continuous medium P1 located upstream of first guide roller R1 will be a path inclined in a direction to turn around first guide roller R1. Such an inclination angle θ of passing path A22 relative to passing path A21 will be referred to as a winding angle.

Similarly, in the state where path selection mechanism 70 selects abutting transport path A12, relative passing path A21, a passing path A23 of continuous medium P1 located downstream of second guide roller R2 will be a path inclined in a direction to turn around second guide roller R2. This inclination angle θ of passing path A23 relative to passing path A21 will also be referred to as a winding angle.

Inclination angle θ on the side of first guide roller R1 and inclination angle θ on the side of second guide roller R2 are equal and accordingly, hereinafter, inclination angle θ on the side of first guide roller R1 will be described.

Tension T applied to continuous medium P1 is normally set to 20 N to 40 N. In a state where abutting transport path A12 is selected, a pressing force F exerted to press continuous medium P1 toward first guide roller R1 is obtained by $F=2T \sin \theta$. When T is fixed, F has a magnitude determined by $\sin \theta$, $\sin \theta$ has a value increasing as inclination angle θ increases. Accordingly, when the inclination angle is increased, pressing force F is also increased.

Depending on the type of continuous medium P1, pressing force F exerted to abut continuous medium P1 against cooling belt 62 may be determined by selecting an amount of moving upstream movable guide roller R11 toward first guide roller R1 and an amount of moving downstream movable guide roller R12 toward second guide roller R2.

When upstream movable guide roller R11 is moved toward first guide roller R1 in an increased amount, inclination angle θ has an increased value. As a result, pressing force F exerted to abut continuous medium P1 against cooling belt 62 can be increased. Downstream movable guide roller R12 can be similarly discussed.

FIG. 6 represents a relationship between types of continuous medium P1 and inclination angles. A case will be described in which continuous medium P1 is divided in sheet weight in grams per square meter (gsm) into three types of 105 (gsm) or less, 106 (gsm) or more and 176 (gsm) or less, and 177 (gsm) or more. Sheet weight in grams per square meter is a representation of a weight of a sheet representing the weight of the sheet per area of 1 $m^2$.

When continuous medium P1 has a sheet weight of 105 gsm, then normally, continuous medium P1 is small in thickness. As a result, it is preferable that the medium be pushed with a large amount of pressure. Upstream movable guide roller R11 is moved in an amount adjusted so that inclination angle θ is 2 degrees. Downstream movable guide roller R12 is also moved in an amount similarly adjusted.

When continuous medium P1 has a sheet weight of 106 (gsm) or more and 176 (gsm) or less, then normally, continuous medium P1 has a standard thickness. As a result, it is preferable that the medium be pushed with a medium amount of pressure. Upstream movable guide roller R11 is moved in an amount adjusted so that inclination angle θ is 1.5 degrees. Downstream movable guide roller R12 is also moved in an amount similarly adjusted.

When continuous medium P1 has a sheet weight of 177 gsm or more, then normally, continuous medium P1 is large in thickness. As a result, it is preferable that the medium be pushed with a small amount of pressure. Upstream movable guide roller R11 is moved in an amount adjusted so that inclination angle θ is 1 degree. Downstream movable guide roller R12 is also moved in an amount similarly adjusted.

Thus, by adjusting the inclination angle based on the type of continuous medium P1, a pressing force appropriate for continuous medium P1 used can be exerted to bias continuous medium P1 toward cooling belt 62. As a result, continuous medium P1 can be optimally cooled.

Furthermore, when continuous medium P1 meanders, then, until the meandering of continuous medium P1 converges, path selection mechanism 70 operates to select non-abutting transport path A11 which does not cause continuous medium P1 to abut against cooling belt 62, and a load on continuous medium P1 and cooling device 60 can be eliminated.

Figure 7:
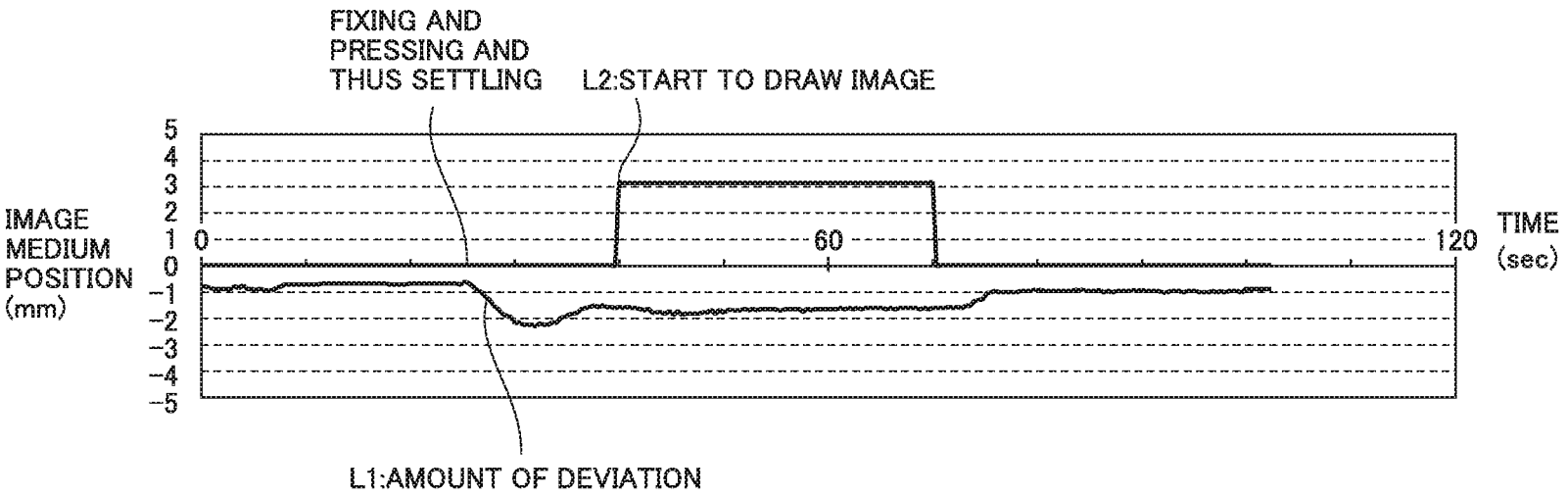
FIG. 7 is a chart figure schematically representing a state of a continuous medium meandering in an embodiment.

FIG. 7 is a chart figure schematically representing a state of continuous medium P1 meandering. The axis of ordinate represents the position (or deviation) of continuous medium P1, and the axis of abscissa represents time. A line L1 represents an amount of deviation of continuous medium P1. A line L2 represents starting to draw an image by transfer device 40.

After image fixing device 50 has finished fixing and pressing and thus settling, continuous medium P1 runs meandering in an amount exceeding −2 mm. Accordingly, starting to draw an image by transfer device 40 is in an OFF state. Thereafter, continuous medium P1 runs meandering in air amount within −2 mm. Accordingly, starting to draw an image by transfer device 40 is set to an ON state.

Thus, while continuous medium P1 runs meandering, path selection mechanism 70 operates to select non-abutting transport path A11 to prevent continuous medium P1 from abutting against cooling device 60, and continuous medium P1 and cooling device 60 can avoid damage (e.g., being flawed by the belt).

Furthermore, in a state where path selection mechanism 70 selects abutting transport path A12, cooling belt 62 may be transported at a rate set to be slower than continuous medium P1 is, and cooling belt 62 may thus follow the movement of continuous medium P1.

In this case, at least one of first guide roller R1, second guide roller R2, third guide roller R3, and fourth guide roller R4 is provided with a drive device, and the drive device can include a one-way mechanism to prevent slipping between continuous medium P1 and cooling belt 62 to prevent continuous medium P1 from being flawed by the belt.

Thus, image formation apparatus 1 in the present embodiment, in a case where continuous medium P1 is used, can dispense with belt-sandwiched cooling in cooling the continuous medium after fixing by heating while preventing the continuous medium from meandering while running.

Furthermore, the apparatus is not increased in size and path selection mechanism 70 that allows selection between non-abutting transport path A11 which does not cause continuous medium P1 to abut against cooling belt 62 and abutting transport path A12 which causes continuous medium P1 to abut against cooling belt 62 is adopted to allow the continuous medium after fixing by heating to be cooled appropriately.

The present image formation apparatus is an image formation apparatus of an electrophotographic system capable of forming an image on a continuous medium, comprising: a sheet feeding device configured to feed the continuous medium; a winding device configured to wind up the continuous medium fed from the sheet feeding device; and a body of the image formation apparatus configured to form an image on the continuous medium while the continuous medium is transported between the sheet feeding device and the winding device.

The body of the image formation apparatus includes: a transfer device configured to transfer a prescribed toner image to the continuous medium; a fixing device configured to apply heat to fix the toner image transferred to the continuous medium; and a cooling device configured to cool the continuous medium heated.

The cooling device has: a cooling belt disposed only on the side of one surface of the continuous medium and having a region which at least abuts against the continuous medium moved in a direction in which the continuous medium is fed; a body of the cooling device abutting against the cooling belt on a side of the cooling belt opposite to that thereof abutting against the continuous medium; first and second guide rollers disposed in the body of the cooling device on upstream and downstream sides, respectively, as seen in the direction in which the continuous medium is fed, and guiding the cooling belt to move in that direction; and a path selection mechanism allowing selection between a non-abutting transport path which does not cause the continuous medium to abut against the cooling belt and an abutting transport path which causes the continuous medium to abut against the cooling belt.

In another form, in a state where the path selection mechanism selects the abutting transport path, relative to a passing path allowing the continuous medium passing between the first guide roller and the second guide roller to abut against the cooling belt, a passing path of the continuous medium located upstream of the first guide roller will be a path inclined in a direction to turn around the first guide roller and a passing path of the continuous medium located downstream of the second guide roller will be a path inclined in a direction to turn around the second guide roller.

In another form, the path selection mechanism, as seen in the direction in which the continuous medium is fed, has: an upstream movable guide roller which is upstream of the first guide roller and located opposite to the first guide roller with the continuous medium posed therebetween; an upstream fixed guide roller which is upstream of the upstream movable guide roller and located opposite to the upstream movable guide roller with the continuous medium posed therebetween; a downstream movable guide roller which is downstream of the second guide roller and located opposite to the second guide roller with the continuous medium posed therebetween; and a downstream fixed guide roller which is downstream of the downstream movable guide roller and located opposite to the downstream movable guide roller with the continuous medium posed therebetween.

By moving the upstream movable guide roller toward the first guide roller and moving the downstream movable guide roller toward the second guide roller, the abutting transport path which causes the continuous medium to abut against the cooling belt is selected, and, from a state where the abutting transport path is selected, by moving the upstream movable guide roller in a direction away from the first guide roller and moving the downstream movable guide roller in a direction away from the second guide roller, the non-abutting, transport path which does not cause the continuous medium to abut against the cooling belt is selected.

In another form, depending on the type of the continuous medium, a pressing force exerted to abut the continuous medium against the cooling belt is determined by selecting an amount of moving the upstream movable guide roller toward the first guide roller and an amount of moving the downstream movable guide roller toward the second guide roller.

In another form, while the continuous medium, after having passed through the fixing device, runs meandering, the path selection mechanism selects the non-abutting transport path.

In another form, in a state where the path selection mechanism selects the abutting transport path, a rate applied to transport the cooling belt is set to be slower than a rate applied to feed the continuous medium to allow the cooling belt to follow movement of the continuous medium.

The present image formation apparatus is configured such that when a continuous medium is used, the continuous medium, after fixing by heating, can be cooled without belt-sandwiched cooling adopted.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A body of an image formation apparatus configured to form an image on a continuous medium, comprising:

a transfer device configured to transfer a prescribed toner image to the continuous medium;

a fixing device configured to apply heat to fix the toner image transferred to the continuous medium; and a cooling device configured to cool the continuous medium heated, the cooling device being disposed only on a side of one surface of the continuous medium and having a selection mechanism allowing selection of either transporting the continuous medium without the continuous medium abutting against the cooling device or transporting the continuous medium while the continuous medium abuts against the cooling device.

2. The body of the image formation apparatus according to claim 1, wherein the cooling device includes:

a cooling belt having a region which at least abuts against the continuous medium moved in a direction in which the continuous medium is transported;

a body of the cooling device against the cooling belt on a side of the cooling belt opposite to that thereof abutting against the continuous medium; and first and second guide rollers disposed in the body of the cooling device on upstream and downstream sides, respectively, as seen in the direction in which the continuous medium is transported, and guiding the cooling belt to move in that direction.

3. The body of the image formation apparatus according to claim 1, wherein the selection mechanism is composed of a path selection mechanism allowing selection of a non-abutting transport path which does not cause the continuous medium to abut against the cooling device and an abutting transport path which causes the continuous medium to abut against the cooling device.

4. The body of the image formation apparatus according to claim 1, wherein the selection mechanism, as seen in the direction in which the continuous medium is transported, includes:

an upstream movable guide roller which is located upstream of the region which at least abuts against the continuous medium;

an upstream fixed guide roller which is upstream of the upstream movable guide roller and located opposite to the upstream movable guide roller with the continuous medium posed therebetween;

a downstream movable guide roller which is located downstream of the region which at least abuts against the continuous medium; and a downstream fixed guide roller which is downstream of the downstream movable guide roller and located opposite to the downstream movable guide roller with the continuous medium posed therebetween, and the selection mechanism moves the upstream movable guide roller relative to the upstream fixed guide roller and moves the downstream movable guide roller relative to the downstream fixed guide roller to allow selection of either transporting the continuous medium without the continuous medium abutting against the cooling device or transporting the continuous medium while the continuous medium abuts against the cooling device.

5. The body of the image formation apparatus according to claim 3, wherein, in the abutting transport path, relative to a passing path allowing the continuous medium passing between the first guide roller and the second guide roller to abut against the cooling belt, a passing path for the continuous medium located upstream of the first guide roller is a path inclined in a direction to turn around the first guide roller, and a passing path for the continuous medium located downstream of the second guide roller is a path inclined in a direction to turn around the second guide roller.

6. The body of the image formation apparatus according to claim 4, wherein the upstream movable guide roller is located opposite to the first guide roller with the continuous medium posed therebetween, the downstream movable guide roller is located opposite to the second guide roller with the continuous medium posed therebetween, the upstream movable guide roller is moved toward the cooling device with respect to the continuous medium and the downstream movable guide roller is moved toward the cooling device with respect to the continuous medium to transport the continuous medium while abutting against the cooling belt, and from a state where the continuous medium is transported while abutting against the cooling belt, the upstream movable guide roller is moved in a direction opposite to the cooling device with respect to the continuous medium and the downstream movable guide roller is moved in the direction opposite to the cooling device with respect to the continuous medium to provide a state where the continuous medium is transported without abutting against the cooling belt.

7. The body of the image formation apparatus according to claim 1, wherein, while the continuous medium, after having passed through the fixing device, runs meandering, the selection mechanism selects transporting the continuous medium without the continuous medium abutting against the cooling device.

8. An electrophotographic image formation apparatus configured to form an image on a continuous medium, comprising:

a sheet feeding device configured to feed the continuous medium;

a winding device configured to wind up the continuous medium fed from the sheet feeding device; and a body of the image formation apparatus configured to form an image on the continuous medium while the continuous medium is transported between the sheet feeding device and the winding device, wherein the body of the image formation apparatus comprises:

a transfer device configured to transfer a prescribed toner image to the continuous medium;

a fixing device configured to apply heat to fix the toner image transferred to the continuous medium; and a cooling device configured to cool the continuous medium heated, the cooling device being disposed only on a side of one surface of the continuous medium and having a selection mechanism allowing selection of either transporting the continuous medium without the continuous medium abutting against the cooling device or transporting the continuous medium while the continuous medium abuts against the cooling device.

9. The image formation apparatus according to claim 8, wherein the cooling device has a cooling belt, and wherein, in a state where the continuous medium is transported through the abutting transport path, a rate applied to transport the cooling belt is set to be slower than a rate applied to feed the continuous medium to allow the cooling belt to follow movement of the continuous medium.

10. The body of the image formation apparatus according to claim 6, wherein, depending on a type of the continuous medium, the upstream movable guide roller and the downstream movable guide roller move, and by selecting an amount of moving the upstream movable guide roller and an amount of moving the downstream movable guide roller, a pressing force exerted to cause the continuous medium to abut against the cooling belt is determined.

11. The body of the image formation apparatus according to claim 10, wherein the type of the continuous medium is a weight of the continuous medium in grams per square meter (gsm).

12. The body of the image formation apparatus according to claim 10, wherein the type of the continuous medium is a thickness of the continuous medium.

13. The body of the image formation apparatus according to claim 5, wherein an inclination angle of a passing path for the continuous medium located upstream of the first guide roller is equal to an inclination angle of a passing path for the continuous medium located downstream of the second guide roller.

14. An electrophotographic image formation apparatus configured to form an image on a continuous medium, comprising:

a sheet feeding device configured to feed the continuous medium;

a winding device configured to wind up the continuous medium fed from the sheet feeding device; and a body of the image formation apparatus configured to form an image on the continuous medium while the continuous medium is transported between the sheet feeding device and the winding device, the body of the image formation apparatus including:

a transfer device configured to transfer a prescribed toner image to the continuous medium;

a fixing device configured to apply heat to fix the toner image transferred to the continuous medium; and a cooling device configured to cool the continuous medium heated, the cooling device having:

a cooling belt disposed only on a side of one surface of the continuous medium and having a region which at least abuts against the continuous medium moved in a direction in which the continuous medium is fed;

a body of the cooling device abutting against the cooling belt on a side of the cooling belt opposite to that thereof abutting against the continuous medium;

first and second guide rollers disposed in the body of the cooling device on upstream and downstream sides, respectively, as seen in the direction in which the continuous medium is fed, and guiding the cooling belt to move in that direction; and a path selection mechanism allowing selection of a non-abutting transport path which does not cause the continuous medium to abut against the cooling belt and an abutting transport path which causes the continuous medium to abut against the cooling belt, the path selection mechanism being such that, in a state where the abutting transport path is selected, relative to a passing path allowing the continuous medium passing between the first guide roller and the second guide roller to abut against the cooling belt, a passing path for the continuous medium located upstream of the first guide roller is a path inclined in a direction to turn around the first guide roller, and a passing path for the continuous medium located downstream of the second guide roller is a path inclined in a direction to turn around the second guide roller, the path selection mechanism, as seen in the direction in which the continuous medium is fed, having:

an upstream movable guide roller which is upstream of the first guide roller and located opposite to the first guide roller with the continuous medium posed therebetween;

an upstream fixed guide roller which is upstream of the upstream movable guide roller and located opposite to the upstream movable guide roller with the continuous medium posed therebetween;

a downstream movable guide roller which is downstream of the second guide roller and located opposite to the second guide roller with the continuous medium posed therebetween; and a downstream fixed guide roller which is downstream of the downstream movable guide roller and located opposite to the downstream movable guide roller with the continuous medium posed therebetween, and by moving the upstream movable guide roller toward the body of the cooling device with respect to the continuous medium and moving the downstream movable guide roller toward the body of the cooling device with respect to the continuous medium, the abutting transport path which causes the continuous medium to abut against the cooling belt being selected, and, from a state where the abutting transport path is selected, by moving the upstream movable guide roller in a direction opposite to the body of the cooling device with respect to the continuous medium and moving the downstream movable guide roller in the direction opposite to the body of the cooling device with respect to the continuous medium, a non-abutting transport path which does not cause the continuous medium to abut against the cooling belt being selected.

15. The image formation apparatus according to claim 14, wherein, depending on a type of the continuous medium, a pressing force exerted to cause the continuous medium to abut against the cooling belt is determined by selecting an amount of moving the upstream movable guide roller toward the cooling device with respect to the continuous medium and an amount of moving the downstream movable guide roller toward the cooling device with respect to the continuous medium.

16. The image formation apparatus according to claim 14, wherein while the continuous medium, after having passed through the fixing device, runs meandering, the path selection mechanism selects the non-abutting transport path.

17. The image formation apparatus according to claim 14, wherein in a state where the path selection mechanism selects the abutting transport path, a rate applied to transport the cooling belt is set to be slower than a rate applied to feed the continuous medium to allow the cooling belt to follow movement of the continuous medium.

* * * * *